US005263566A

United States Patent [19]

Nara et al.

[11] Patent Number: 5,263,566

[45] Date of Patent: Nov. 23, 1993

[54] COIN DISCRIMINATING APPARATUS

[75] Inventors: Takehiko Nara, Aichi; Toru Ueki, Gifu, both of Japan

[73] Assignee: Matsushita Electric Industrial Co., Ltd., Osaka, Japan

[21] Appl. No.: 861,730

[22] Filed: Apr. 1, 1992

[30] Foreign Application Priority Data

Apr. 10, 1991 [JP] Japan ..... 3-077548
Aug. 23, 1991 [JP] Japan ..... 3-212024

[51] Int. Cl.[5] ..... G07D 5/02; G07D 5/08

[52] U.S. Cl. ..... 194/318; 194/335

[58] Field of Search ..... 194/317, 318, 319, 217, 194/334, 335

[56] References Cited

U.S. PATENT DOCUMENTS 3,682,286 8/1972 Prumm ..... 194/334 X
3,870,137 3/1975 Fougere .
3,918,565 11/1975 Fougere et al. .
4,124,111 11/1978 Hayashi ..... 194/334
4,705,154 11/1987 Masho et al. ..... 194/335 X
4,875,567 10/1989 Fitton ..... 194/318
5,078,251 1/1992 Hayashi et al. ..... 194/318
5,078,252 1/1992 Furuya et al. ..... 194/318

FOREIGN PATENT DOCUMENTS 2715403 10/1977 Fed. Rep. of Germany ..... 194/318
2235559 3/1991 United Kingdom ..... 194/318

*Primary Examiner*—F. J. Bartuska
*Attorney, Agent, or Firm*—Lowe, Price, LeBlanc & Becker

[57] ABSTRACT

The present invention relates to a coin discriminating apparatus and method for discriminating genuine coins from counterfeit coins, and determining their denominations. And more particularly, the present invention purports to detect genuine coins based on the inherent difference in degree of peripheral thickening or convex configuration between genuine coins and counterfeit coins so as to provide a coin discriminating apparatus and method capable of preventing counterfeit coins from being used in an unauthorized or unfair way. In one specific example, there is provided a thickness detecting sensor 8 adjacent to a coin passage, and a coin face contour detecting apparatus 11 measures a time during which an output of the thickness sensor 8 exceeds a threshold value 22, thereby detecting degree of peripheral thickening or convex configuration of coins to discriminate genuine coins from counterfeit.

9 Claims, 9 Drawing Sheets

COIN DISCRIMINATING APPARATUS

BACKGROUND OF THE INVENTION

1. Field of the Invention:

The present invention relates to coin discriminating apparatus and method capable of electrically discriminating whether a used coin in vending machines etc. is genuine or not and also detecting its denomination.

2. Description of the Prior Art:

Recently, vending machines become very popular. And these vending machines are normally equipped with coin discriminating apparatus, which are normally required high performance enough to be capable of discriminating coins.

Conventional coin discriminating apparatus comprises three different kinds of sensors for detecting material, thickness, and outer-diameter, respectively, and signal processing circuits receiving output signals from these sensors. With this arrangement, genuine or not of the coin to be detected is discriminated by detecting all of material, thickness, and outer-diameter of the coin.

As relevant prior arts relating to this kind of technique, there have been known the U.S. Pat. No. 3,870,137 and the U.S. Pat. No. 3,918,565.

However, in such a conventional constitution, there was a problem such that an unauthorized use or unfair use of counterfeit coins such as a flat metal made of a similar material and having similar thickness and outer-diameter might be undetected or missed. Furthermore, in view of number of sensors, it requires at least three sensors for all the detection of material, thickness, and outer-diameter of the coin to be detected.

SUMMARY OF THE INVENTION

It is therefore a first object of the present invention, in order to resolve the aforementioned problems and disadvantages encountered in the art, to provide the coin discriminating apparatus and method capable of protecting such an unauthorized or unfair use of counterfeit coins. Further, it is a second object of the present invention to detect a plurality of properties; i.e. material, thickness, outer-diameter and so on, by using a single sensor in order to realize a compact apparatus in size.

First of all, to protect an unauthorized or unfair use of counterfeit coins in accordance with the first aspect of the present invention, a coin discriminating apparatus comprises a coin inlet, a coin passage disposed from this coin inlet toward the downstream thereof, a thickness detecting sensor provided on a side wall of the coin passage, a coin outlet provided downstream of the thickness detecting sensor, and a signal processing circuit for processing output signals fed from the thickness detecting sensor; in which, said signal processing circuit is constituted such that it judges degree of convex configuration formed on an outer peripheral portion (hereinafter, referred to as a "coining") of the coin to be detected by measuring a period of time during which a value of output signal from the thickness detecting sensor exceeds a predetermined threshold value.

Moreover, in order to reduce the size of the system in accordance with the second aspect of the present invention, said sensor comprises a single core wound by two kinds of coils serving as a part of a thickness detecting sensor and a part of a material detecting sensor, respectively. The degree of coining of coins is judged by measuring a period of time during which a value of output signal from the thickness detecting sensor exceeds a predetermined threshold value.

With this arrangement, it becomes possible to detect the degree of coining of coins. And, as a result, it becomes possible to judge whether the coin to be used is genuine or counterfeit on the basis of the inherent difference of degree of coining between the genuine coins and the counterfeit coins, thereby surely preventing the counterfeit coins from being unfairly used. Furthermore, since a single sensor in accordance with the present invention can detect a plurality of properties of coins, it further becomes possible to provide a compact apparatus in size by virtue of reduction of the number of sensors.

The above and other objects, features and advantages of the present invention will become more apparent from the following detailed description which is to be read in conjunction with the accompanying drawings.

DETAIL DESCRIPTION OF THE PREFERRED EMBODIMENT

Hereinafter, referring now to the accompanying drawings, a preferred embodiment of the present invention is explained in detail.

FIRST EMBODIMENT

Figure 4:
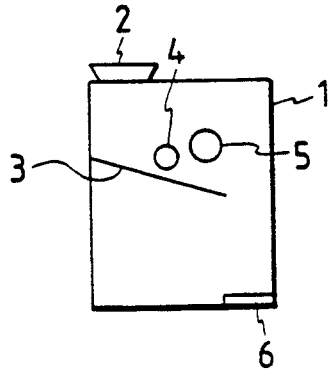
FIG. 4 is a schematic view showing a constitution of a coin discriminating apparatus in accordance with the first embodiment of the present invention.

FIG. 4 is a schematic view showing a constitution of a coin discriminating apparatus in accordance with the first embodiment of the present invention. A main body 1 of the coin discriminating apparatus has an upper portion provided with a coin inlet 2. A coin passage 3 is provided so as to extend from the coin inlet 2 toward the inclined downward direction. This coin passage 3 has a side wall disposed with a combined material and thickness sensor 4 and an outer-diameter sensor 5. The coin passage 3 has a lower end directed to a coin outlet 6 which is provided downstream of the coin discriminating apparatus. The U.S. Pat. No. 3,870,137 shows more practical detail structure of this kind of apparatus, therefore, this prior are should be referred together to understand the specific structure of the coin discriminating apparatus embodying the present invention.

Figure 1:
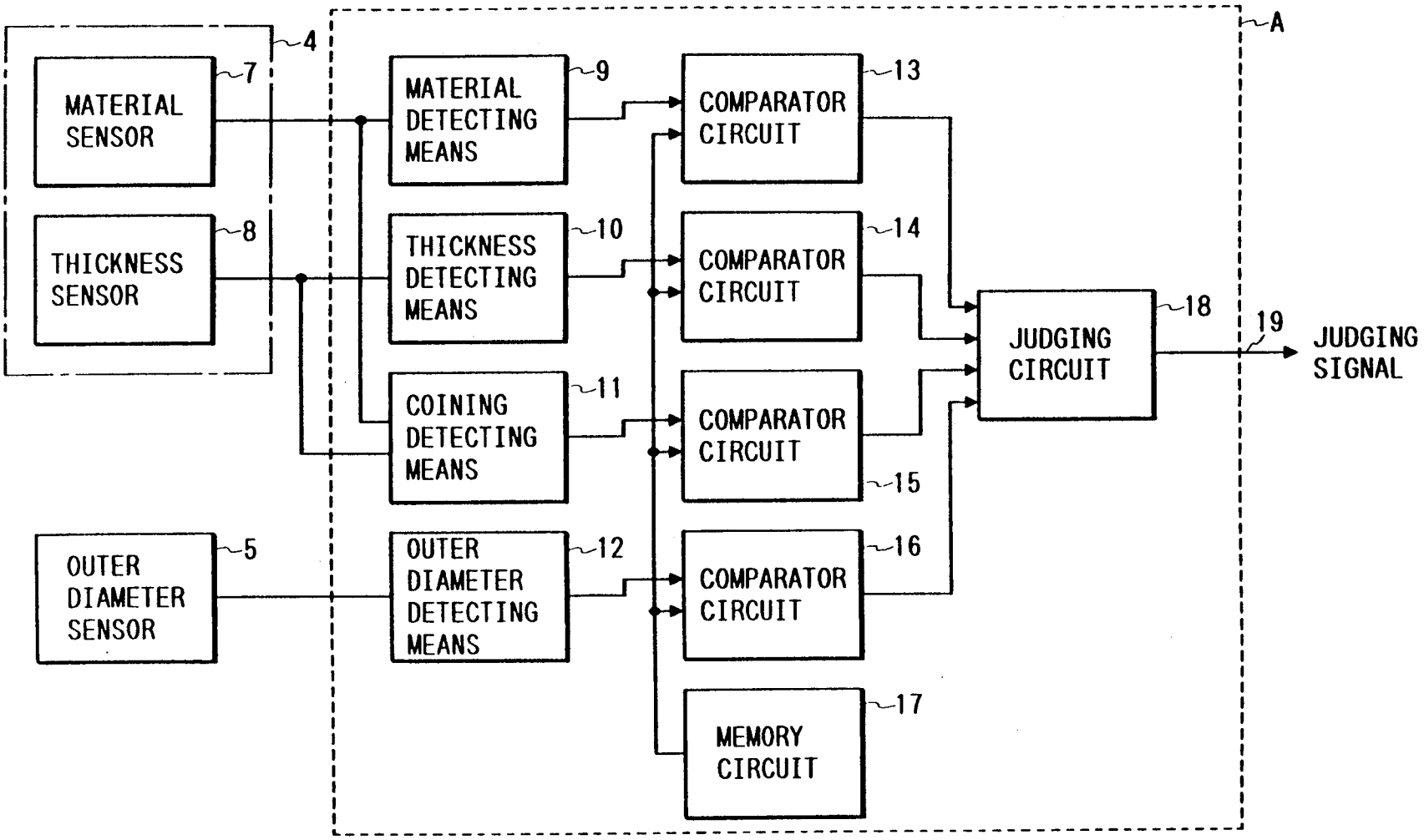
FIG. 1 is a block diagram showing a constitution of a control circuit in accordance of a first embodiment of the present invention.

FIG. 1 is a block diagram showing a constitution of a control circuit in accordance with a first embodiment of the present invention. The material sensor 7 housed in the combined material and thickness sensor 4 consists of a pair of ferrite pot cores disposed on the coin passage 3 so as to oppose with each other, coils wound in the cores, an oscillation circuit constituted by the coils for outputting oscillation wave signals, and a half-wave rectification circuit which transduces an oscillation waveform signal of sine-wave into a signal indicating an oscillation level. Coils wound in the opposed cores are connected with each other in series and in the same-phase so that mutual inductance becomes positive. Output signals of the material sensor 7 are fed into a material detecting means 9 and a coining detecting means 11 which are provided in a signal processing circuit A.

A thickness sensor 8 has a similar constitution to the material sensor 7 except that coils wound in the opposing cores are connected with each other in series but in opposite-phase so that mutual inductance becomes negative. Output signals of the thickness sensor 8 are fed into a thickness detecting means 10, which is also provided in the signal processing circuit A, and the means for detecting the contour (especially peripheral thickening or convex configuration) of coin faces 11. In this embodiment, the material sensor 7 and the thickness sensor 8 are associated with a common core and are shown in FIG. 4 as the combined material/thickness sensor 4. Details of this material/thickness sensor 4 is explained in more specifically in an explanation of a second embodiment later. But, it would be needless to mention that the material sensor 7 and the thickness sensor 8 can be provided separately and independently with each other.

The outer-diameter sensor 5 has a similar constitution to the material sensor 7. Coils wound in the opposed cores are connected with each other in series and in the same-phase so that mutual inductance becomes positive. And, output signals of the outer-diameter sensor 5 are fed into an outer-diameter detecting means 12 which is provided in the signal processing circuit A.

Each of the detecting means 9 to 12 consists of an A/D converter circuit and a detecting circuit. And, output terminals of the detecting means 9 to 12 are connected to comparator circuits 13 to 16, repsectively. These comparator circuits 13 to 16 are further connected at their another input terminals to a memory circuit 17. Respective outputs from the comparator circuits 13 to 16 are fed into a judging circuit 18, and the judging circuit 18 outputs a judging signal 19.

Next, an operation of the coin discriminating apparatus constituted as described above is explained hereinafter. When the coin introduced from the coin inlet 2 approaches to the sensors 4 and 5, the coils in the sensors 4 and 5 change their impedances in response to this approach by the coin. And, based on these changes, oscillation levels of the oscillation circuits are also changed. Respective sensors are made so as to show unique changes in such a manner that the above-changing amounts in the oscillation circuits represent characteristic features in accordance with chiefly materials of coins in case of the material sensor 7 or chiefly thicknesses of coins in case of the thickness sensor 8, or chiefly outer-diameter of coins in case of the outer-diameter sensor 5. Previously described U.S. Patents as prior arts disclose in detail regarding such characteristic features of the sensors.

The material detecting means 9, the thickness detecting means 10, and the outer-diameter detecting means 12 detect respectively the maximum change amount of the oscillation level when the coin passes in front of them, and output detected signals to the respective corresponding comparator circuits 13, 14, and 16.

Figure 2:
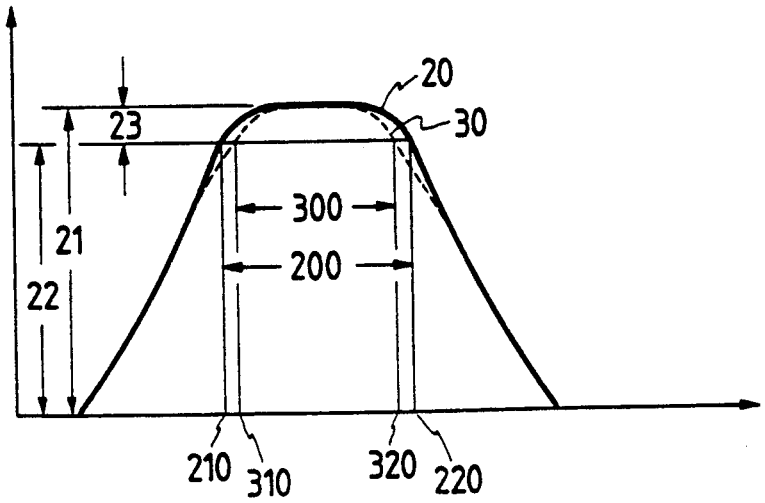
FIG. 2 is a view showing waveforms of output signals fed from a thickness detecting sensor utilized in the first embodiment of the present invention.
Figure 3:
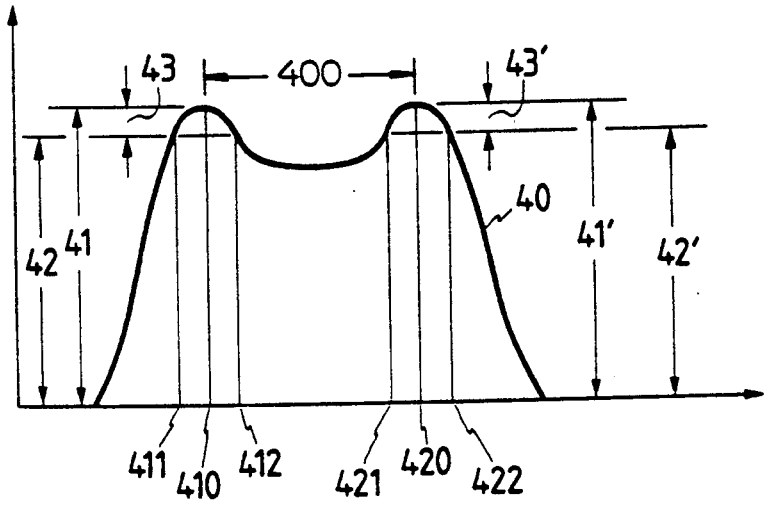
FIG. 3 is a view showing a waveform of output signal fed from a material detecting sensor utilized in the first embodiment of the present invention.

Next, an operation of the coining detecting means 11 is explained referring to FIGS. 2 and 3. FIG. 2 is a view showing waveforms 20 and 30 of output signals fed from the thickness detecting sensor 8 detected when the coin to be measured passes adjacent the thickness detecting sensor 8. FIG. 3 is a view showing a waveform 40 of output signal fed from the material detecting sensor 7 detected when the coin to be measured passes adjacent the material detecting sensor 7. In both graphs 2 and 3, an ordinate represents a changing amount of oscillation level, and an abscissa represents time.

In FIG. 2, a solid line 20 shows a waveform of 500-yen of Japanese currency, and a broken line 30 shows a waveform of flat plate-shaped metal having substantially the same material, thickness, and outer-diameter as 500-yen. The waveform of 500-yen and that of the flat plate-shaped metal are almost identical but different in some portions. These different portions are found by the inventors of the present application to just correspond to the timings that the outer peripheral portion of the coin to be measured passes adjacent the thickness sensor 8, therefore, it is recognized that the difference at these timings precisely expresses degree of peripheral thickening or convex configuration of the coins. That is, the present invention purports to detect the degree of coining of coins on the basis of the output signal of the thickness sensor having such a characteristic feature.

Hereupon, the output waveform 40 of the material sensor 7 is completely identical between the 500-yen and the flat plate-shaped metal as shown in FIG. 3.

In this first embodiment, in order to set a threshold value, a certain value obtained by subtracting a predetermined amount 23 from the maximum value 21 is set as a threshold value 22. A period of time during which an output signal of the thickness sensor 8 exceeds the threshold value 22 is measured by comparing the output signal of the thickness sensor 8 with the threshold value 22. Thus, the degree of coining is detected by obtaining the period of time 200 or 300 during which an amount of the output signal from the thickness sensor 8 exceeds the threshold value 22.

The reason why the present embodiment determines the threshold value by reducing a predetermined amount 23 from the maximum value 21 is such that adoption of a fixed or a permanent threshold value is sensitively influenced by temperature change or electric power supply voltage change. But, it is not limited to the disclosed embodiment, it is also desirable to obtain the threshold value by multiplying the maximum value 21 by a constant amount such as 0.9. The period of time 200 or 300 during which the output signal from the thickness sensor 8 exceeds the threshold value 22 is obtained by subtracting the time 210 or 310 at which an amount of the output signal increases above the threshold value 22 from the time 220 or 320 at which an amount of the output signal falls below the threshold value 22.

Furthermore, in this embodiment, method for obtaining time 210, 310, 320, and 220 is carried out in such a manner that output signals from the sensor 8 are converted in the means for detecting the contour of the coin faces 11 from an analogue signal to a digital signal at regular intervals and, in turn, if the output signal of the thickness sensor 8 is equal to the threshold value 22 at a certain time, the actual time is directly adopted as the time 210, 310, 320, and 220, and, if the output signal is not equal to the threshold value 22, an interpolated time calculated based on adjacent two output signals of the thickness sensor 8 sandwiching the threshold value 22 and the threshold value 22 itself in the following manner is used as a crossing time; i.e. the time 210, 310, 320, and 220.

Figure 11:
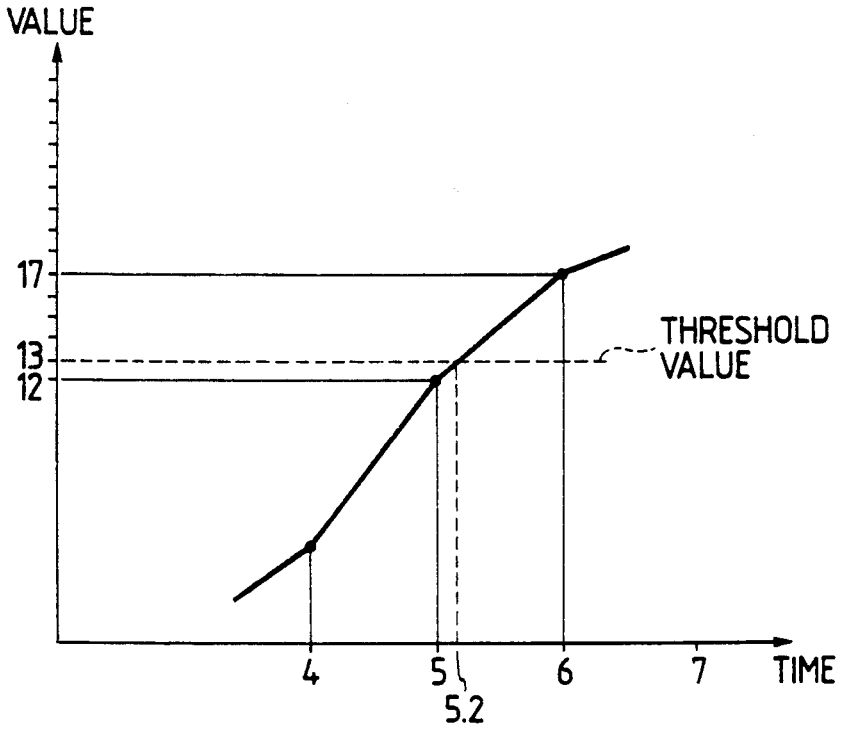
FIG. 11 is a graph illustrating an interpolation method for obtaining a time when an output signal of the thickness detecting sensor exceeds a threshold value.

That is, referring to FIG. 11, if it is supposed that the threshold value 22 is 13, and the output signal of the thickness sensor 8 exceeds this threshold value 22 during an interval between a time 5 and a time 6, the interpolated time (Ti) is calculated in the following equation.

$$\frac{\text{Threshold value} - \text{Value at time 5}}{\text{Value at time 6} - \text{Value at time 5}} = \frac{Ti - 5}{6 - 5}$$

Here, if entered the values of the threshold value (i.e. 13), the value at the time 5 (i.e. 12), and the value at the time 6 (i.e. 17) from the drawing, above equation becomes as follows.

$$\frac{13 - 12}{17 - 12} = \frac{Ti - 5}{6 - 5}$$

Therefore, the interpolated time Ti becomes 5.2.

Thus obtained period of times 200, 300 during which output signals from the thickness sensor 8 exceed the threshold value 22 are apparently influenced by the passing speeds of coins, therefore, it is required to carry out a correction based on the passing speed of the coin. This embodiment utilizes a period of time 400 corresponding to a mutual distance of two peaks of a twin-peaked waveform of the output signal of the material sensor 7, as shown in FIG. 3, since this mutual distance between two peaks is considered to be proportional to the passing speed of coin. However, needless to say, it is possible to carry out the correction by utilizing anything else showing the passing speed of coin.

This period of time 400 is obtained by subtracting the time 410 at which the output signal from the material sensor 7 gained the first peak value from the tune 420 It which the output signal from the material sensor 7 gained the second peak value. In order to accurately obtain the time at which the output signal from the material sensor 7 gains the peak value, the present embodiment performs the following calculations.

That is, referring now to the first peak value, a threshold value 42 is obtained by reducing a predetermined value 43 from the first peak value 41, and subsequently, a time 410 is obtained as a first peak time by averaging the time 411 at which an amount of the output signal increases above the threshold value 42 and the time 412 at which an amount of the output signal falls below the threshold value 42.

In the same way, in case of the second peak value, a threshold value 42' is obtained by reducing a predetermined value 43' from the second peak value 41', and subsequently, a time 420 is obtained as a second peak time by averaging the time 421 at which an amount of the output signal increases above the threshold value 42' and the time 422 at which an amount of the output signal falls below the threshold value 42'.

The means for detecting the contour of the coin faces 11 obtains a ratio of the time period 200 or 300 showing a time duration during which the amount of output signal of the thickness sensor 8 exceeds the threshold value 22 to the time period 400 corresponding to the interval of twin peaks of output signal from the material sensor 7. And, the means for detecting the contour of the coin faces 11 sends out a signal indicating the above obtained ratio the comparator circuit 15.

The memory circuit 17 memorizes reference values in accordance with denominations of genuine coins. The comparator circuits 13 to 16 compare input signals from the respective detecting means 9 to 12 with the reference values in the memory circuit 17. In respective comparator circuits 13 to 16, if any one of differences between the input signals from the detecting means and the reference values of denominations of coins is within an acceptable error zone, a signal indicating a denomination of corresponding genuine coin is output. To the contrary, if all the differences between the input signals from the detecting means and the reference values of denominations of coins are not within the acceptable error zone, a signal indicating counterfeit coin is output. The judging circuit 18 outputs, as the judging signal 19, a signal indicating a denomination of genuine coin only when all the signals from the comparator circuits 13 to 1.6 show the same denomination of the genuine coins. In other words, the judging circuit 18 outputs, as the judging signal 19, a signal indicating a counterfeit coin unless all the signals from the comparator circuits 13 to 16 show the same denomination of the genuine coins.

As described in a foregoing description, in accordance with the first embodiment of the present invention, it becomes possible to detect the degree of peripheral thickening or convex configuration of coins based on the output signals occurring when the outer peripheral portion of the coin to be detected passes adjacent the thickness sensor 8.

By the way, though this embodiment uses the time periods 200 or 300 showing the duration during which the output signal of the thickness sensor 8 exceeds the threshold value 22, it is possible to detect the degree of peripheral thickening of coins by using any kinds of methods other than the disclosed embodiment if such methods utilize the output signals from the thickness sensor 8 generated at the timing that the outer peripheral portion of the coin to be checked just passes the thickness sensor 8.

Furthermore, though this embodiment shows an example in which the oscillation level change occurring at the timing the coin passes the thickness sensor is chiefly utilized to discriminate the genuine or not of coins, it is also desirable to adopt any of inductance change, frequency change, phase change, and so on if it utilizes the impedance change of coil occurring due to the influence of coin.

Moreover, though the combined material sensor 7 and the thickness sensor 8 is adopted to minimize the influence of passing speed change of coin, it is as a matter of course acceptable even if two independent sensors are provided.

As described in the foregoing description, the coin discriminating apparatus of the first embodiment of the present invention comprises a means for detecting the degree of peripheral thickening of coin, therefore, it becomes possible to accurately discriminate the genuine coins and the counterfeit coins since the genuine coins and the counterfeit coins have mutually different degree of coining, thereby protecting the unauthorized or unfair usage of the counterfeit coins in vending machines.

SECOND AND THIRD EMBODIMENTS

Next, a second embodiment of the present invention is explained hereinafter by referring to the drawings.

Figure 6:
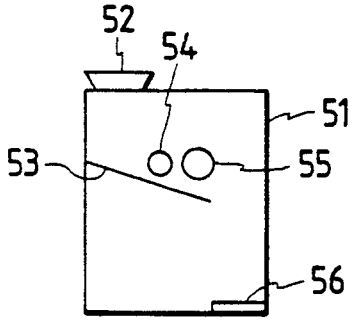
FIG. 6 is a schematic view showing a constitution of a coin discriminating apparatus in accordance with the second embodiment of the present invention.

FIG. 6 is a schematic view showing a constitution of a coin discriminating apparatus in accordance with the second embodiment of the present invention. In the drawing, a main body 51 of the coin discriminating apparatus has an upper portion provided with a coin inlet 52. A coin passage 53 is provided so as to extend from the coin inlet 52 toward the inclined downward direction. This coin passage 53 has a side wall disposed with a combined material and thickness sensor 54 and an outer-diameter sensor 55. The coin passage 53 has a lower end directed to a coin outlet 56 which is provided downstream of the coin discriminating apparatus.

Figure 5:
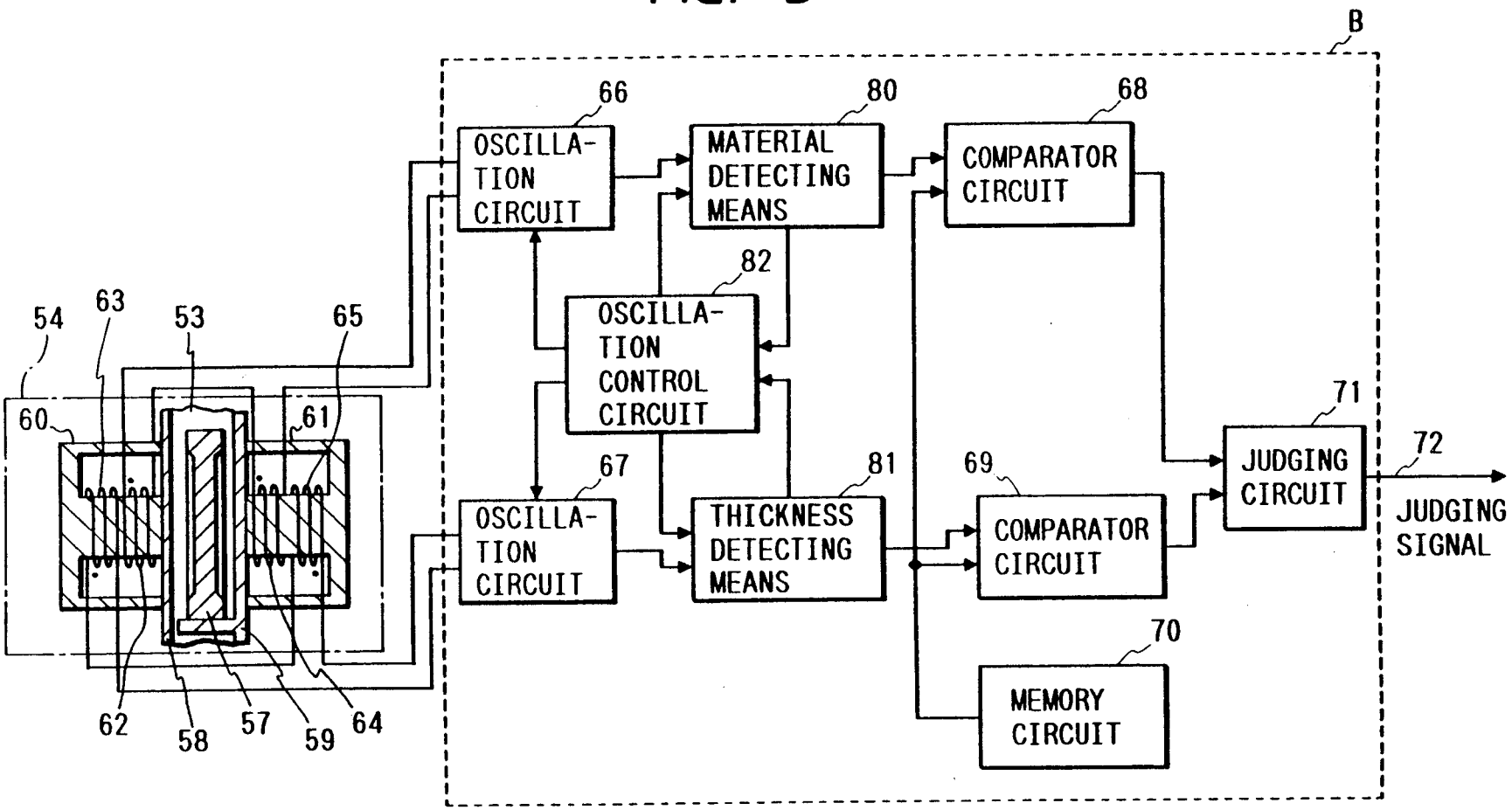
FIG. 5 is a cross-sectional view showing a combined material and thickness detecting magnetic sensor in accordance with a second embodiment of the present invention, accompanying a block diagram showing a constitution of a control circuit thereof.

FIG. 5 is a cross-sectional view stowing a combined material and thickness detecting magnetic sensor in accordance with a second embodiment of the present invention, accompanying a schematic block diagram showing a constitution of a control circuit thereof.

The coin passage 53 for a coin 57 consists of a base plate 58 forming one side wall, and a base plate 59 forming a rail lying at a bottom portion and an opposing side wall. The base plate 58 and the base plate 59 have respective walls on which ferrite pot cores 60, 61 are installed to oppose with each other. The cores 60, 61 have respective outer diameters smaller than an outer diameter of the minimum coin 57 to be discriminated. Further, the cores 60, 61 have respective centers having a mutual relationship with the coin 57 having a minimum outer diameter such that the center of the coin 57 just passes adjacent the centers of the cores 60, 61.

The combined material and thickness sensor 54 consists of the pair of ferrite pot cores 60, 61 disposed on the coin passage 3 so as to oppose with each other, coils 62, 63 and 64, 65 wound in the cores 60, 61, respectively. The coils 62 and 64 have one ends connected with each other in series and in the same-phase so that their mutual inductance becomes positive. And also, the coils 62 and 64 have the other ends connected to in oscillation circuit 66 of the signal processing circuit B. On the other hand, the coils 63 and 65 have one ends connected with each other in series but in opposite-phase so that their mutual inductance becomes negative. And also, the coils 63 and 65 have the other ends connected to an oscillation circuit 67 of the signal processing circuit B. Hereupon, the oscillation circuit 66 and the oscillation circuit 67 have mutually different oscillation frequencies.

The oscillation circuit 66 generates output signals of oscillation waveform, which are fed through a material detecting means 80 to a comparator circuits 68. In the same way, the oscillation circuit 67 generates output signals of oscillation waveform, which are fed through a thickness detecting means 81 to a comparator circuit 69. In this case, the oscillation signal obtained from the oscillation circuit 66 or 67 are soon converted into a signal representing the maximum change amount of oscillation level detected when the coin passes the combined material and thickness sensor 54 before it is transmitted to the comparator circuit 68 or 69.

Each of the detecting means 80 and 81 consists of a half-wave rectification circuit, an A/D converter circuit and a detecting circuit. The half-wave rectification circuit converts the oscillation waveform signal of sine-wave into a signal indicating an oscillation level. And, connected to both of these comparator circuits 68, 69 is a memory circuit 70. Outputs from these comparator circuits 68, 69 enter into a judging circuit 71 and, in response to these outputs, the judging circuit 71 generates a judging signal 72. Further, a reference numeral 82 denotes an oscillation control circuit 82. This oscillation control circuit 82 controls switching transistors (not shown) provided at feedback terminals of the oscillation circuits 66, 67. That is, each of the oscillation circuit 66 or 67 ceases its oscillation by turning on its switching transistor.

The outer-diameter sensor 55 has the similar constitution as the one disclosed in the first embodiment, thus, an explanation of the outer diameter sensor 55 is omitted here.

Next, an operation of the coin discriminating apparatus constituted as described above is explained hereinafter. When the coin 57 introduced from the coin inlet 52 approaches to the combined material/thickness sensors 54, impedances of the coils 62 to 65 can be changed. And, in response to these changes, oscillation levels in the oscillation circuits 66, 67 are also changed. The material/thickness sensor 54 is made so as to show unique changes in such a manner that the above-changing amounts in the oscillation circuits 66, 67 represent characteristic features in accordance with chiefly materials of coins in case of the oscillation circuit 66 or chiefly thicknesses of coins in case of the oscillation circuit 67. Hereupon, previously described U.S. Patents disclose in detail regarding such characteristic features of the sensors.

Figure 7A:
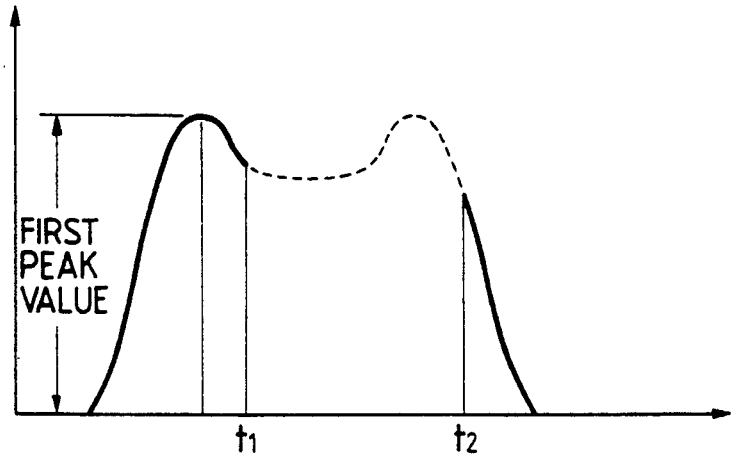
FIG. 7A is a view showing a waveform of output signal fed from a material detecting sensor utilized in the second embodiment of the present invention.
Figure 7B:
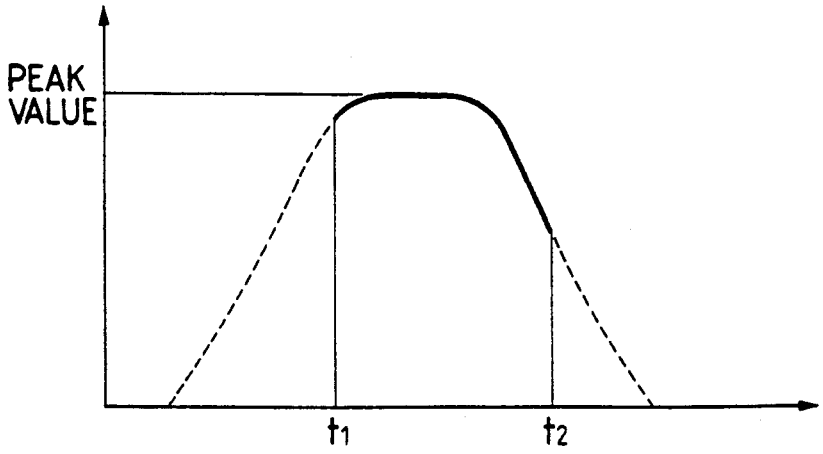
FIG. 7B is a view showing a waveform of output signal fed from a thickness detecting sensor utilized in the second embodiment of the present invention.

Referring now to FIGS. 7A and 7B, an operation of the oscillation control circuit 82 is explained hereinafter. FIG. 7A is a view showing waveform of output signal fed from a material detecting sensor (i.e. coils 62, 64, oscillation circuit 66, and material detecting means 80) utilized in the second embodiment of the present invention and controlled by the oscillation control circuit 82. And FIG. 7B is a view showing a waveform of output signal fed from a thickness detecting sensor (i.e. coils 63, 65, oscillation circuit 67, and thickness detecting means 81) utilized in the second embodiment of the present invention and controlled by the oscillation control circuit 82.

In an initial condition, only the material sensor causes oscillation in the oscillation circuit 66. When the coin 57 to be detected approaches to the combined material and thickness sensor 54, the material detecting means 80 detects a first peak value (as shown in FIG. 7A) and feeds this peak value to the comparator circuit 68 as well as sends a changeover signal to the oscillation control circuit 82 at the timing t1 to cease the oscillation in the oscillation circuit 66 and activate the oscillation in the oscillation circuit 67. The oscillation control circuit 82 feeds a detection request signal to the thickness detecting means 81. Upon receiving this detection request signal, the thickness detecting means 81 detects a peak value (as shown in FIG. 7B) and feeds this peak value to the comparator circuit 69 as well as sends a changeover signal to the oscillation control circuit 82 at the timing t2 to cease the oscillation in the oscillation circuit 67 and activate the oscillation in the oscillation circuit 66.

The memory circuit 70 memorizes reference peak amounts in accordance with denominations of genuine coins. The comparator circuits 68, 69 compare peak amounts of oscillation levels occurring when the coin 57 to be detected has passed the sensor 54 with the reference peak amounts in the memory circuit 70. If difference of the compared two values in the comparator circuit 68 or 69 is within an acceptable error range, a signal indicating a denomination of corresponding genuine coin is output. To the contrary, if this difference is out of the acceptable error range with respect to all the reference peak amounts in the memory circuit 70, a signal indicating counterfeit coin is output. The judging circuit 71 outputs, as the judging signal 72, a signal indicating a denomination of genuine coin only when all the signals from the comparator circuits 68, 69 show the same denomination of the genuine coins. In other words, the judging circuit 71 outputs, as the judging signal 72, a signal indicating a counterfeit coin unless all the signals from the comparator circuits 68, 69 show the same denomination of the genuine coins.

As described in a foregoing description, in accordance with the second embodiment of the present invention, there are provided two cores 60, 61 disposed to oppose with each other. These cores 60, 61 are wound by two of coils 62, 63 and 64, 65, respectively. Further, the coils 62 and 64 wound in the respective opposing cores 60, 61 are connected with each other in series and in the same-phase so that their mutual inductance becomes positive. Namely, these coils 62, 64 serve as a part of a material sensor. On the other hand, the coils 63 and 65 wound in the respective opposing cores 60, 61 are connected with each other in series but in opposite-phase so that their mutual inductance becomes negative. Namely, these coils 63, 65 serve as a part of a thickness sensor. In other words, these coils 62, 64 and coils 63, 65 constitute mutually independent oscillation circuits. As a result, it becomes possible to provide a single magnetic sensor capable of detecting material, thickness, and peripheral thickening (contour of the faces) of coins.

Figure 8:
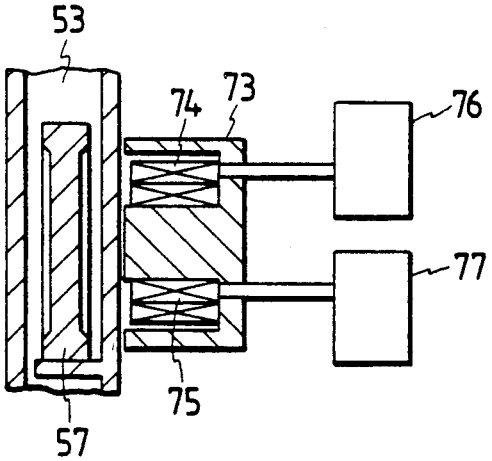
FIG. 8 is a block diagram showing a constitution of a magnetic sensor in accordance with the third embodiment of the present invention.

Though the second embodiment explains the case in which the cores 60, 61 are disposed so as to oppose with each other, the present invention is not limited to this constitution. For example, as shown in FIG. 8, only one core 73 can be provided so as to be installed on the wall of the coin passage 53. And, this core 73 accommodates a pair of coils 74, 75 wound therein. These coils 74, 75 are connected to mutually independent oscillation circuits 76, 77, respectively. By using such a magnetic sensor it is further possible to provide a coin discriminating apparatus that accomplishes the purpose of the present invention.

Furthermore, though this embodiment shows an example in which the oscillation level change occurring at the timing the coin passes the sensor is chiefly utilized to discriminate the genuine or not of coins, it is also desirable to adopt any of inductance change, frequency change, phase change, and so on as long as that utilizes the impedance change of coil occurring when the coin passes the sensor.

Moreover, regarding influences by other coil, through experiments and computer simulations for oscillation circuits, it is affirmed that if oscillation frequencies are mutually separated such influence can be suppressed within 1% with respect to the oscillation level change occurring when the coil passes the sensor. Further, it is needless to say that it is preferable to select an optimum oscillation frequency suitable for the own property of the coin to be detected in each oscillation circuit. For instance, if the maximum change amount is obtained, it would be recognized as an optimum oscillation frequency.

As above-described second embodiment, in the case that the influence by other coils becomes problem even though it remains as fairly small one, it is possible to provide switches in either electric power sources or feedback portions of respective oscillation circuits so as to cause oscillation or cease it. If these switches are controlled by an oscillation control circuit, it becomes possible to control a plurality of coils wound in a single core not to oscillate at the same time. Or, it becomes possible to switch over the coil to be oscillate at an appropriate timing. However, it should be noted that the oscillation control circuit is basically optional in view of inventive aspect of the second embodiment.

In accordance with the second or third embodiment of the coin discriminating apparatus of the present invention, by providing a single core wound by a plurality of coils and constituting these coils as a magnetic sensor including mutually independent oscillation circuits, it becomes possible that a single magnetic sensor can detect a plurality of properties of coins at the same time. Accordingly, number of magnetic sensors can be reduced, thereby realizing a coin discriminating apparatus capable of reducing size and attaining cost saving.

FOURTH EMBODIMENT

Figure 9:
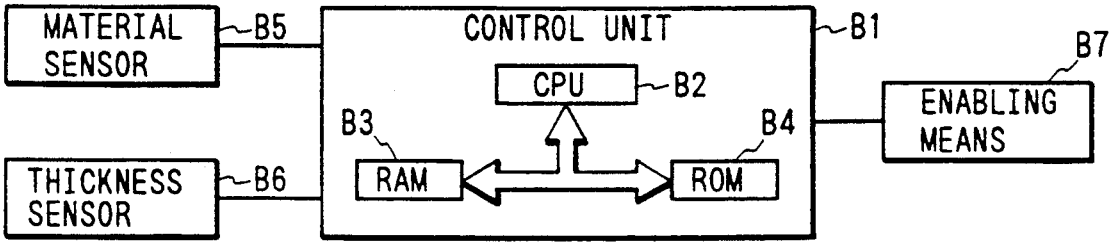
FIG. 9 is a schematic block diagram of a control unit in accordance of a fourth embodiment of the present invention.

Now referring to the FIGS. 9, 10A, 10B, and 10C, a fourth embodiment of the present invention is explained hereinafter in detail. The fourth embodiment performs the same function as the first embodiment by using program-controlled computer instead of the disclosed circuitry in FIG. 1. FIG. 9 is a schematic block diagram of a control unit in accordance of the fourth embodiment of the present invention, and FIGS. 10A, 10B, and 10C are flow charts practiced in the control unit of the fourth embodiment of the present invention.

As shown in FIG. 9, the control unit B1 is a conventional micro computer comprising a CPU (i.e. central processing unit) B2, a RAM (i.e. random access memory) B3, and a ROM (i.e. read only memory) B4. A material sensor B5 is associated with the control unit B1 to supply a material detecting signal. And, a thickness sensor B6 is also associated with the control unit B1 to supply a thickness detecting signal. A reference numeral B7 denotes an enabling means which is connected to the output terminal of the control unit B1 and outputs an enabling signal for example to solenoids to select coins in accordance with their denominations or to an overall control unit of vending machine to use the discriminating judging signal.

Figure 10A:
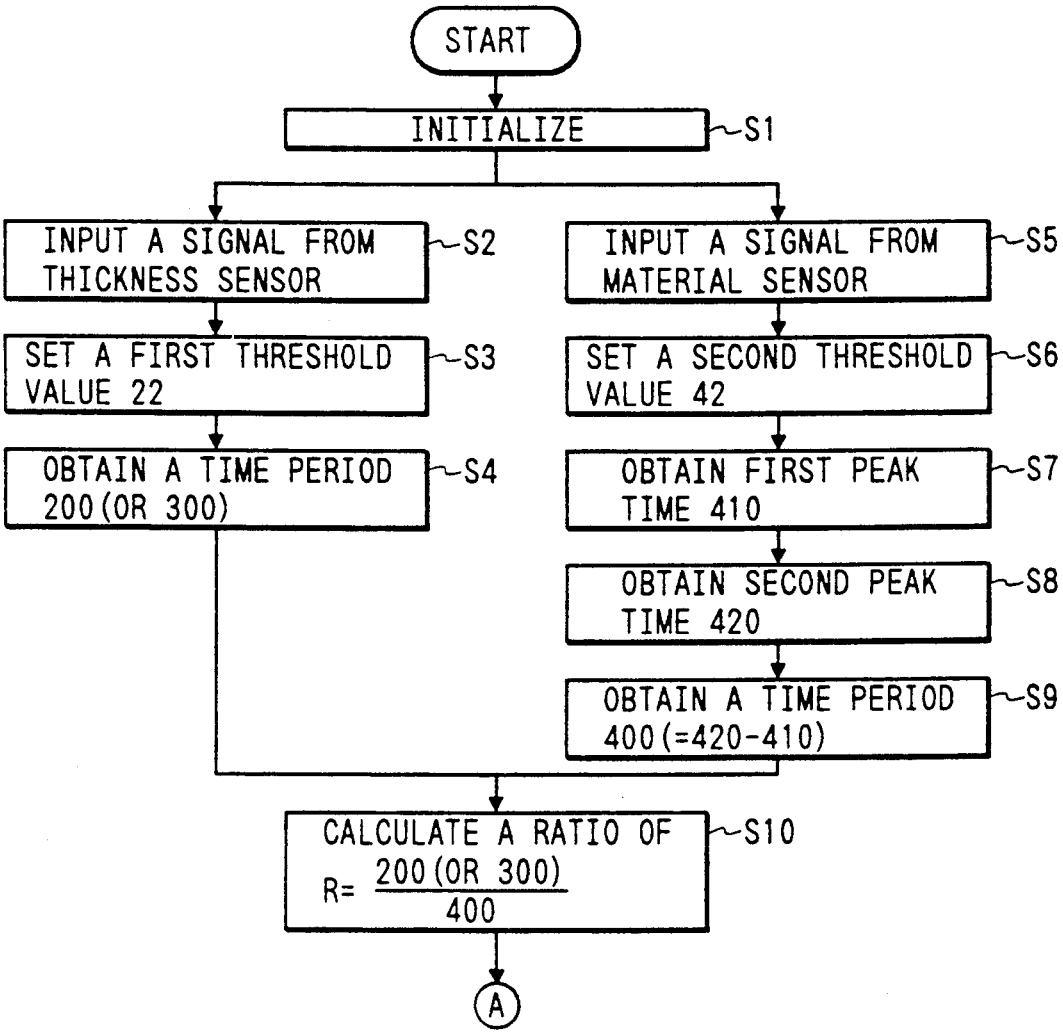
FIGS. 10A, 10B, and 10C are flow charts practiced in the control unit of the forth embodiment of the present invention.
Figure 10B:
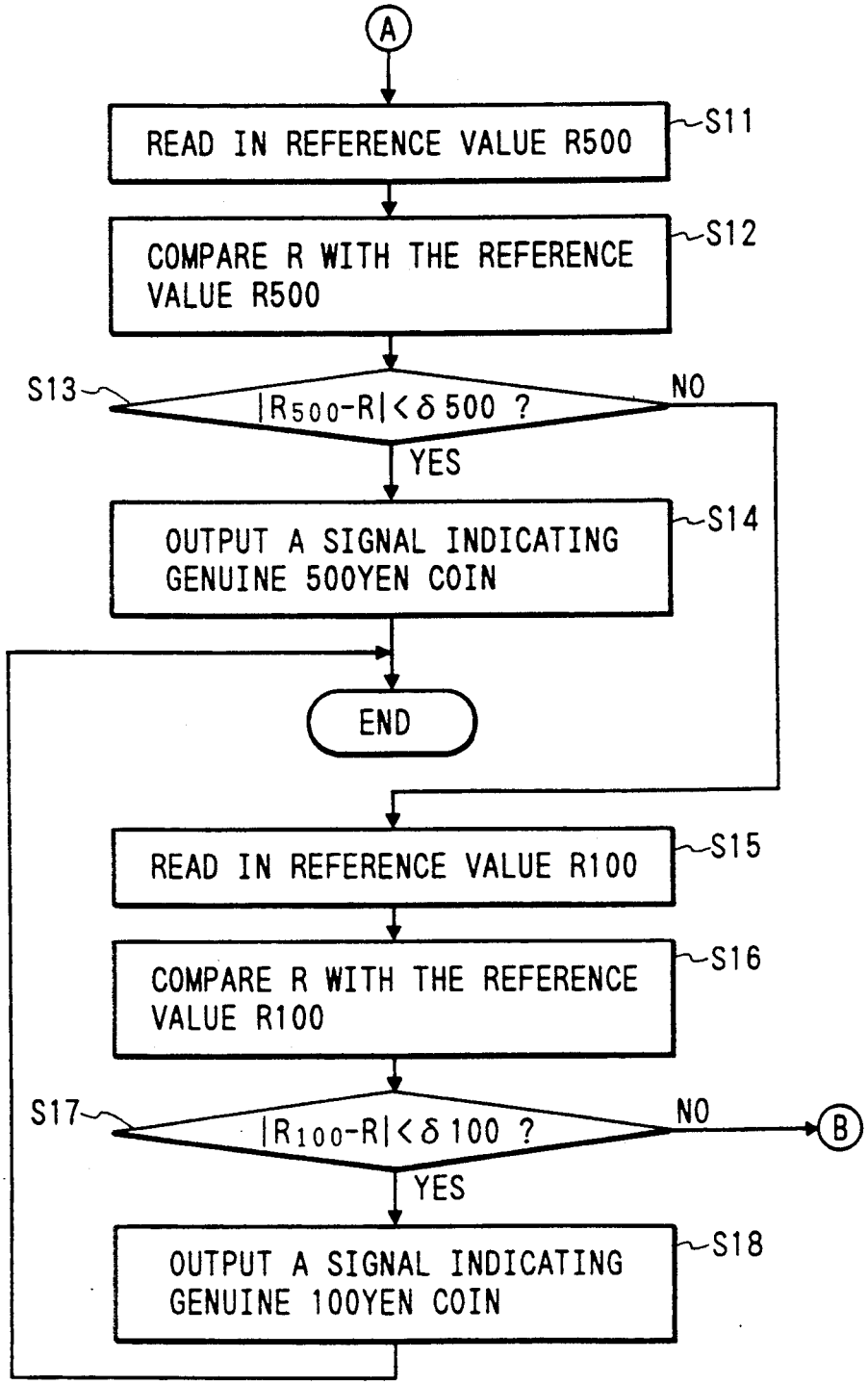
Figure 10C:
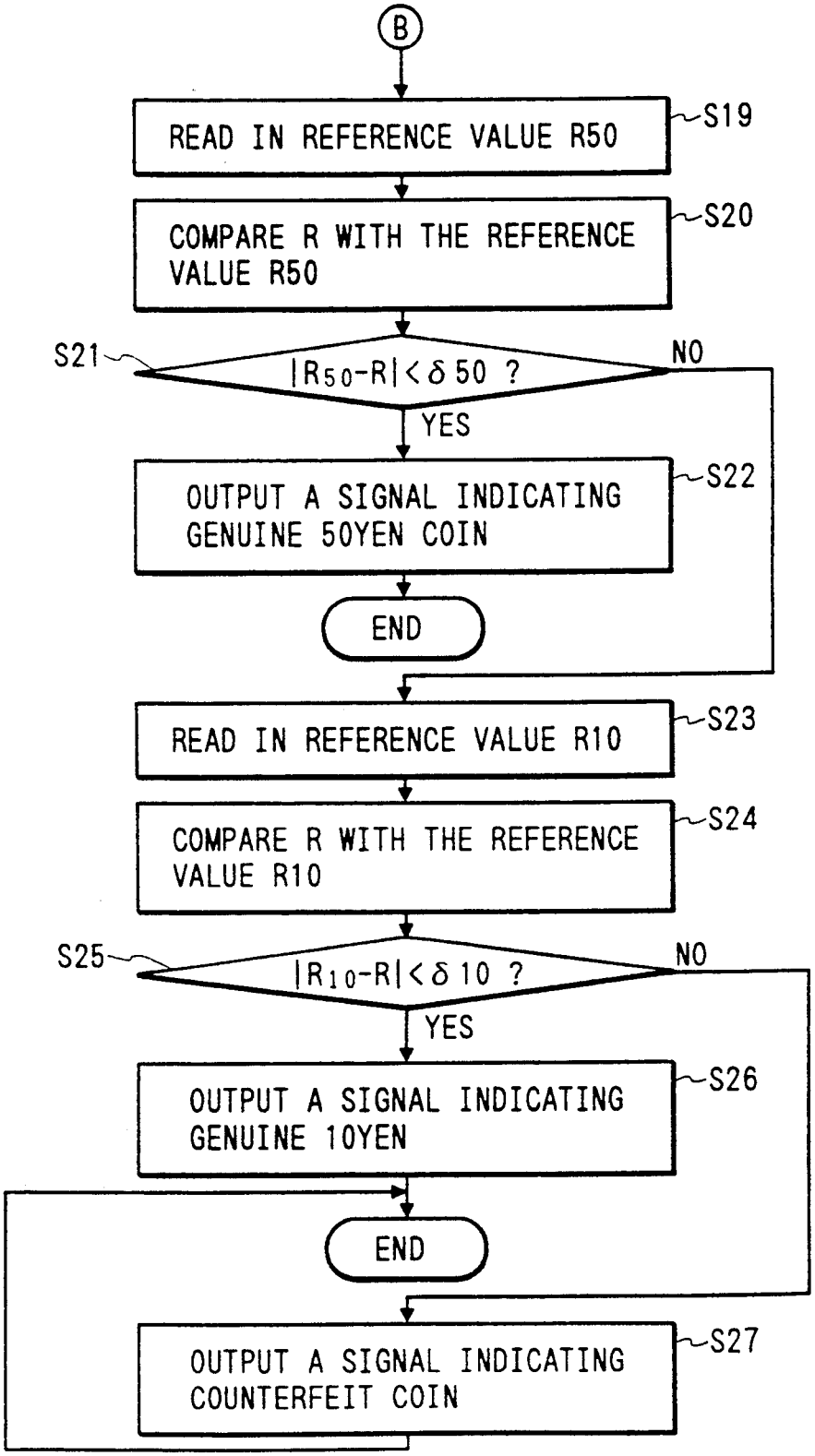

Discriminating method of coins is explained by the flow charts in FIGS. 10A, 10B, and 10C, wherein especially method for detecting the contour of the coin faces (peripheral thickening) is described in detail but material detecting method and thickness detecting method etc. are not disclosed for purposes of facilitative explanation.

First of all, the program initializes data in a step S1. Then, program proceeds to carry out parallel procedures, i.e. from step S2 to step S4 and from step S5 to step S9. Because, the material sensor B5 and the material sensor B6 are a type of combined magnetic sensor as shown in the second embodiment, therefore, signals from both sensors B5 and B6 generate simultaneously.

In the step S2 a signal from the thickness sensor B6 is input, and in the step S3 a first threshold value 22 is set. Subsequently in the step S4, a time period 200 (or 300) of FIG. 2 is obtained by comparing the signal from the thickness sensor B6 and the threshold value 22. On the other hand, in the step S5, a signal from the material sensor B5 is input, and in the step S6 a second threshold value 42 is set. Subsequently in the steps S7 and S8, a first peak time 410 and a second peak time 420 are obtained. Then, in the step S9, a time period 400 (=420 - 410) is obtained.

Next, the program proceeds to a step S10 to calculate the following ratio.

$$R = 200(\text{or } 300)/400.$$

Then, at first, it is checked whether or not the detected coin is 500 yen. That is, in a step S11, a reference value R500 is read in. This reference value R500 is compared with above obtained ration R in a step S12. And, the program subsequently judges whether or not the absolute value of difference (R5OO−R) is smaller than a predetermined error δ500 in a step S13. This predetermined error δ500 is a unique value determined based on property of 500 yen. If the judgement in the step S13 is YES, the program proceeds to a step S14 to output a signal indicating genuine 500 yen coin. To the contrary, if the judgement in the step S13 is NO, the program goes to a step S15 to repeat the same procedure as above steps S11 through S14 with respect to 100 yen.

Namely, it is checked whether or not the detected coin is 100 yen. In a step S15, a reference value R100 is read in. This reference value R100 is compared with above obtained ration R in a step S16. And, the program subsequently judges whether or not the absolute value of difference (R100−R) is smaller than a predetermined error δ100 in a step S17. This predetermined error δ100 is a unique value determined based on property of 100 yen. If the judgement in the step S17 is YES, the program proceeds to a step S18 to output a signal indicating genuine 100 yen coin. To the contrary, if the judgement in the step S17 is NO, the program goes to a step S19 to repeat the same procedure as above steps S15 through S18 with respect to 50 yen.

Namely, it is checked whether or not the detected coin is 50 yen. In a step S19, a reference value R50 is read in. This reference value R50 is compared with above obtained ration R in a step S20. And, the program subsequently judges whether or not the absolute value of difference (R50−R) is smaller than a predetermined error, δ50 in a step S21. This predetermined error δ50 is a unique value determined based on property of 50 yen. If the judgement in the step S21 is YES, the program proceeds to a step S22 to output a signal indicating genuine 50 yen coin. To the contrary, if the judgement in the step S21 is NO, the program goes to a step S23 to repeat the same procedure as above steps S19 through S22 with respect to 10 yen.

Namely, it is checked whether or not the detected coin is 10 yen. In a step S23, a reference value R10 is read in. This reference value R10 is compared with above obtained ration R in a step S24. And, the program subsequently judges whether or not the absolute value of difference (R10−R) is smaller than a predetermined error δ10 in a step S25. This predetermined error δ10 is a unique value determined based on property of 10 yen. If the judgement in the step S25 is YES, the program proceeds to a step S26 to output a signal indicating genuine 10 yen coin. To the contrary, if the judgement in the step S25 is NO, the program goes to a step S27 to output a signal indicating counterfeit coin. After finishing above procedures, program ends its overall operation.

In accordance with the fourth embodiment of the present invention, the same function as the first embodiment is carried out by using program-controlled computer.

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A coin discriminating apparatus comprising:

a coin inlet;

a coin passage connected to said coin inlet;

a thickness detecting sensor provided on a side wall of said coin passage;

a coin outlet provided downstream of said thickness detecting sensor;

a signal processing means for processing output signals fed from said thickness detecting sensor and measuring a period of time during which a value of output signal from the thickness detecting sensor exceeds a predetermined first threshold value, so as to judge whether convex configuration formed on a circumferential periphery portion of said coin to be detected is genuine or counterfeit;

said signal processing means being further associated with a material detecting sensor outputting a signal of twin-peaked waveform based on material of said coin to be detected, so that said period of time during which the value of an output signal from the thickness detecting sensor exceeds the predetermined first threshold value is adjusted by a value of a time interval between two peaks of said twin-peaked waveform of the output signal from the material detecting sensor so as to judge whether said convex configuration is genuine or counterfeit.

2. A coin discriminating apparatus in accordance with claim 1 in which a second threshold value is set by subtracting a predetermined amount from a peak value of the output signal of the material detecting sensor, and a peak time at which the output signal from the material detecting sensor gains the peak value is calculated by averaging a time at which the output signal of the material detecting sensor exceeds the second threshold value and a time at which the output signal of the material detecting sensor falls below the second threshold value.

3. A coin discriminating apparatus in accordance with claim 1 in which said thickness detecting sensor and said material detecting sensor are combined in a single magnetic sensor.

4. A coin discriminating apparatus in accordance with claim 3 in which said thickness detecting sensor includes a first coil and said material detecting sensor includes a second coil, and these first and second coils are wound around a common magnetic core.

5. A coin discriminating apparatus in accordance with claim 4 in which said first coil is connected to a first oscillation circuit and said second coil is connected to a second oscillation circuit, and said first and second oscillation circuits have mutually different oscillation frequencies.

6. A coin discriminating apparatus in accordance with claim 4 in which said first coil is connected to a first oscillation circuit and said second coil is connected to a second oscillation circuit, and said first and second oscillation circuits are activated or deactivated by an oscillation control means.

7. A coin discriminating apparatus in accordance with claim 4 in which said first coil is divided into two parts being disposed at opposite sides of said coin passage and connected in series with opposite phases so that their mutual inductance is negative and, to the contrary, said second coil is divided into two parts being disposed at opposite sides of said coin passage and connected in series and in phase so that their mutual inductance is positive.

8. A coin discriminating apparatus in accordance with claim 1 in which said predetermined first threshold value is a value obtained by subtracting a predetermined amount from the maximum value of the output signal from the thickness detecting sensor.

9. A coin discriminating apparatus in accordance with claim 1 in which said predetermined first threshold value is a value obtained by multiplying a constant amount by the maximum value of the output signal from the thickness detecting sensor.

* * * * *